US005251364A

United States Patent [19]

Münster

[11] Patent Number: 5,251,364

[45] Date of Patent: Oct. 12, 1993

[54] DRAWING DEVICE FOR SYNTHETIC FILAMENTS

[75] Inventor: Hinrich Münster, Ennigerloh, Fed. Rep. of Germany

[73] Assignee: E. I. du Pont de Nemours and Company, Wilmington, Del.

[21] Appl. No.: 895,687

[22] Filed: Jun. 9, 1992

[30] Foreign Application Priority Data

Jun. 25, 1991 [DE] Fed. Rep. of Germany ..... 4129839

[51] Int. Cl.[5] ..... D02J 1/22

[52] U.S. Cl. ..... 28/240; 226/195; 74/128; 28/245

[58] Field of Search ..... 28/240, 241, 242, 245, 28/246; 74/526, 527, 128, 822, 813 L; 242/157; 226/196, 199, 195, 197

[56] References Cited

U.S. PATENT DOCUMENTS

| | | | |
|---|---|---|---|
| 3,776,796 | 12/1973 | Lipscomb et al. . | |
| 3,790,056 | 2/1974 | Schmidt et al. | 226/195 |
| 4,532,864 | 8/1985 | Heller et al. | 226/197 X |
| 4,534,235 | 8/1985 | Mitcham et al. | 74/128 |
| 4,916,783 | 4/1990 | Hagewood et al. | 28/245 X |
| 5,020,383 | 6/1991 | Kanaya | 74/128 |
| 5,199,351 | 4/1993 | Shibuya | 226/197 X |

FOREIGN PATENT DOCUMENTS

| | | |
|---|---|---|
| 0298316 | 7/1987 | European Pat. Off. . |
| 3705105 | 2/1992 | Fed. Rep. of Germany . |
| 753232 | 7/1956 | United Kingdom . |

*Primary Examiner*—Clifford D. Crowder
*Assistant Examiner*—John J. Calvert

[57] ABSTRACT

An improved draw pin device for use in drawing synthetic filaments is disclosed, the draw pin being rotated stepwise by means of a stepper switch device with the rotation being affected by the pulling action of the filaments.

7 Claims, 3 Drawing Sheets

DRAWING DEVICE FOR SYNTHETIC FILAMENTS

FIELD OF THE INVENTION

The invention relates to a drawing device for drawing synthetic polymeric filaments to increase their strength.

BACKGROUND OF THE INVENTION

Synthetic polymeric filaments are relatively weak as they are extruded from a spinneret. Therefore, they are drawn to several times their initial length during the subsequent transport via rolls so as to orient their molecules in the lengthwise direction. The drawing is performed between two feeder rolls driven at different feeding speeds between which rolls a draw pin is arranged along the circumferential surface of which the filaments are frictionally moved at a wrap angle. The draw pin concentrates the drawing effect at a specific point on the filaments' path, namely the point immediately behind the draw pin.

Draw pins are subject to high wear. The friction of the filaments on the pin causes grooves in the surface of the draw pin. This is particularly a problem with filaments containing pigments where, especially at higher drawing speeds, the very fine and hard pigment particles cut into the surface of the draw pins. With a worn down surface of the draw pin, the draw pin generates increased friction, there being the danger of filament damage or even of filament rupture. Therefore, it is necessary to regularly change the portion of the draw pin surface that is in contact with the filaments Customarily, the draw pins that are fixedly mounted on the drawing device in a defined position are loosened and rearranged so that another surface portion is used. To do so, however, the machine must normally be stopped. If it is not stopped, there is considerable risk of injury to the machine operator's fingers since the rearranging procedure requires operations in the immediate vicinity of the running filaments. Upon changing the portion contacted by the filaments, a "sawtooth effect" will occur. This means that the filaments first run over a not worn down area of the draw pin, which area will become increasingly worn down during further operation, and that eventually the quality of the filaments will deteriorate. If the draw pin is subsequently placed elsewhere, the filaments will first pass over a not worn down area which again will deteriorate increasingly. Thus filament quality varying in time is obtained U.S. Pat. No. 3,776,796 and German Patent 37 05 105 describe drawing devices wherein the draw pin is continuously rotated by a slowly running drive in order to change the active portion of its surface. Such a slowly running rotating drive requires considerable effort since it requires a motor and, usually, a stepdown gear. Moreover, there is constant consumption of energy.

It is the object of this invention to provide a drawing device for synthetic filaments that, without requiring a drive means, allows a change of the contact portion of the draw pin while filament transport continues, and that also ensures uniform filament quality.

SUMMARY OF THE INVENTION

The present invention involves a drawing device for synthetic filaments, the device comprising at least one draw pin, the filaments sliding frictionally along the circumference of the pin to form a wrap angle, the draw pin being rotatable about its longitudinal axis in order to change the portion of the pin circumference exposed to the filaments. One embodiment of the invention is characterized in that the draw pin is coupled to a stepper switch device for stopping said pin and releasing it after a predetermined time so that it rotates for one angular step, the angular step being smaller than the wrap angle. The stepper switch device preferably includes an index disc fixedly connected to the draw pin and having circumferentially distributed arresting elements, and blocking means capable of engaging the arresting elements but which when disengaged allows for rotation of the index disc in angular steps.

Another embodiment of the invention involves a method for drawing filaments around a draw pin, the filaments sliding frictionally against a portion of the circumference of the pin to form a wrap angle, comprising the steps of (a) blocking the draw pin against rotation about its longitudinal axis; and (b) periodically releasing the pin so that as it is pulled along by said filaments it may rotate by a predetermined angular step, said step being smaller than the wrap angle. After a series of such angular rotations, typically amounting to a 360° rotation, the pin is displaced along a longitudinal axis so that the filaments slide functionally at a new position along the length of the pin.

DETAILED DESCRIPTION

Figure 1:
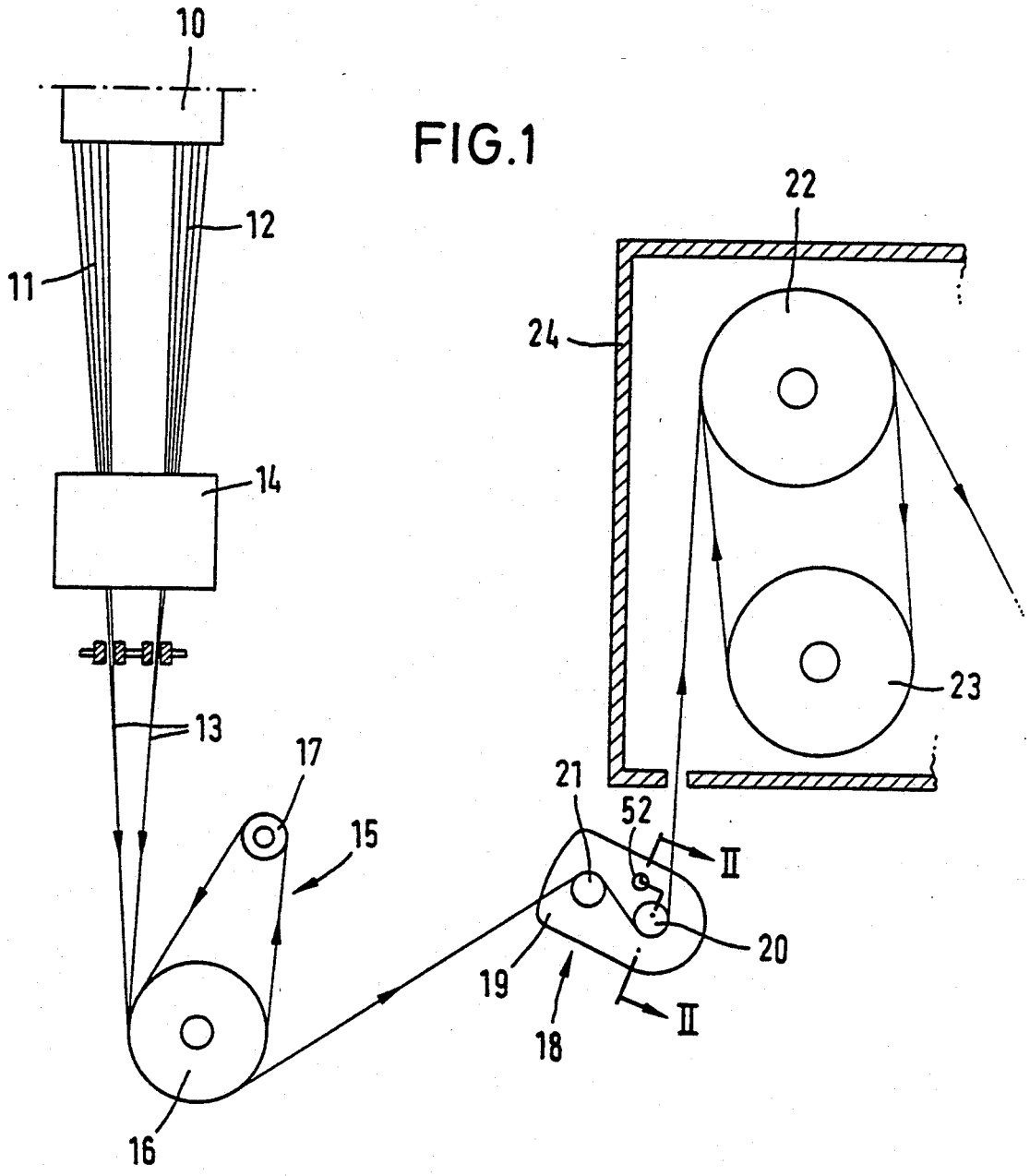
FIG. 1 is a schematic view of a spinning machine with an adjoining drawing device.

In the drawing device of the present invention, the draw pin is stopped by a stepper switch device and enabled at predetermined points in time so that it can rotate further by a defined angular step. The further rotation is performed by the pulling effect of the filaments so that an external drive is not required for rotation. The magnitude of an angular step allowed for by the stepper switch device is less than the wrap angle, which results in the fact that a circumferential portion of the draw pin is in contact with the running filaments for the first time during a first angular step and remains in contact with the filaments during subsequent angular steps. Thus, the wrap angle includes portions of the draw pin surface that are in contact with the filaments for a longer time and one portion that first comes in contact with the filaments only after the most recent rotation. Consequently, at each step the wrap angle includes portions of the draw pin surface with different degrees of wear. If the draw pin is rotated by one angular step, there will again be contact areas with different degrees of wear; however, the average degree of wear in the area of the wrap angle is always almost the same. As a consequence, there is no or only a negligible sawtooth effect and drawn filaments of uniform quality are obtained.

The stepper switch device forms a restraining device that locks the draw pin and releases it only to rotate by defined angular steps, the rotation being effected by the filaments. The stepper switch device is preferably driven periodically by a control means in order to perform stepped switching at uniform intervals. However, it is also possible to operate the stepper switch device by hand, for example by pressing a button. One advantage is that the stepper switch device consumes less energy and is largely maintenance-free since its components are only rarely moved.

In a preferred embodiment of the invention, the stepper switch device comprises an index disc with circumferentially distributed arresting elements. Blocking elements engage these arresting elements, one of the blocking elements engaging and holding one arresting element, respectively. In the meantime, the other blocking element is in a stand-by position. When the blocking element in engagement is withdrawn, the further rotation of the index disc by one angular step will bring another arresting element into the area of the second blocking element by which it will be stopped. In this manner, the number of angular steps into which a complete revolution of 360° is divided is twice the number of the arresting elements.

When the index disc or the draw pin has completed one full revolution of 360°, the circumferential portion at the respective draw pin length is worn down and the draw pin may be displaced axially in order to use a new portion of its length.

The stepper switch unit may be operated with air cylinders, elastic linear drives, solenoids, or by hand. Suitably, upon completion of one rotation cycle an alarm signal is generated so that maintenance personnel can displace the draw pin axially. It is also possible to effect such an axial displacement automatically by means of a suitable drive.

The invention improves the uniformity of the product and product quality while reducing production costs.

The following is a detailed description of one embodiment of the present invention with reference to the accompanying drawings.

FIG. 1 illustrates a spinneret block 10 that is part of a two-end spinning machine that generates two filament bundles 11, 12 at the same time. The filament bundles 11, 12 pass along a finish roll 14 in which they are treated With a liquid preparation substance and move on to a feeder device 15 consisting of a driven feed roll 16 and a separator roll 17. The feeder device pulls off the filaments 13 at a defined speed and supplies them to the drawing device 18 for drawing. The drawing device 18 has a support block 19 to which the draw pin 20 and a rotatable roll 21 are affixed. The filament bundles 11 and 12 first pass over the rotatable roll 21 and, thereafter, over the fixed draw pin 20 to the draw rolls 22 and 23 that are heated and accommodated in a housing 24. The draw rolls 22, 23 rotate several times faster than the rolls of the feeder device 15 so that the filaments are drawn behind the draw pin 20.

The draw pin 20 has a cylindrical smooth surface, preferably consisting of chrome. The wrap angle of the filaments 13 at the draw pin 20 is at least approximately 40°. This wrap angle is selected according to the respective requirements. In the illustrated embodiment, the angle is about 130°.

Figure 2:
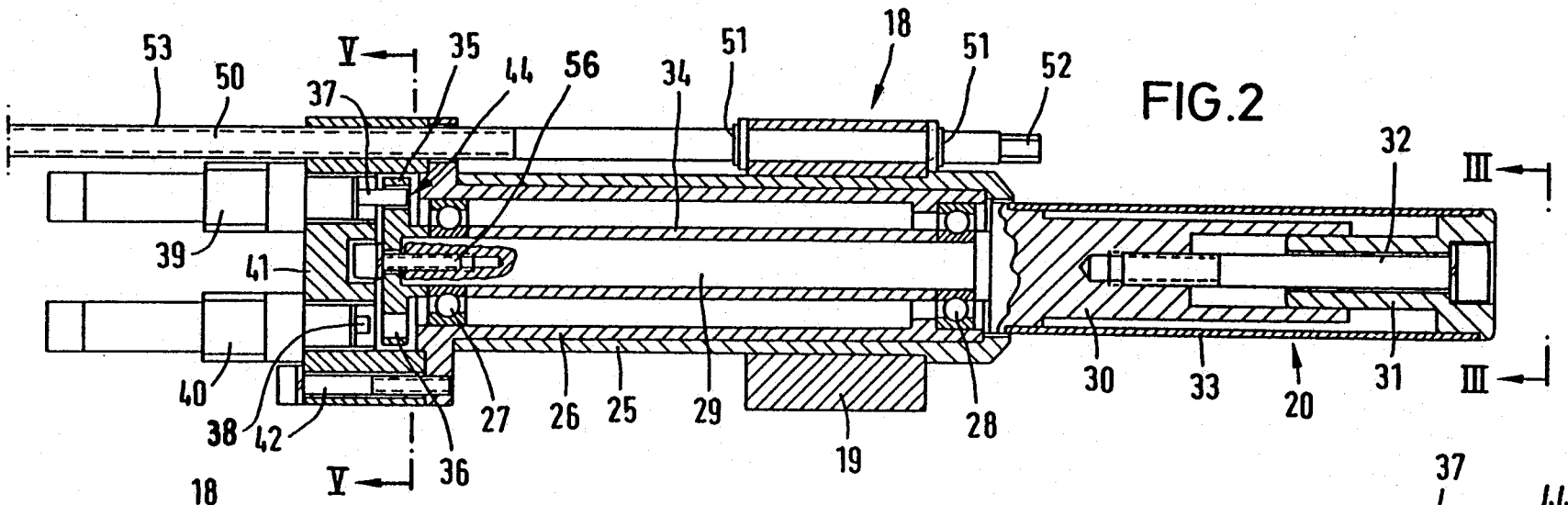
FIG. 2 is a section along line II—II in FIG. 1.

As shown in FIG. 2, a tube 25 is fixedly mounted in a bore of the support block 19, which tube is fastened to the support block 19 by press fitting or welding. In the tube 25, a tubular bearing housing 26 is guided for longitudinal displacement. The ends of the bearing housing 26 are provided with ball bearings 27, 28 in which a shaft is rotatably supported. The support member 30 of the draw pin 20 is mounted on the one end of the shaft 29. A tensioning member 31 that may be tensioned towards the support member 30 by means of a screw, extends into an axial bore of the support member. The shell 33 of the draw pin 20 extends between the end pieces of the support member 30 and the tensioning member 31. This shell has a chrome-plated circumferential surface on which the filaments lie.

Figure 4:
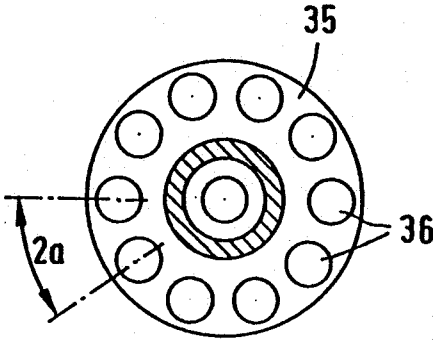
FIG. 4 is an illustration of the index disc.
Figure 3:
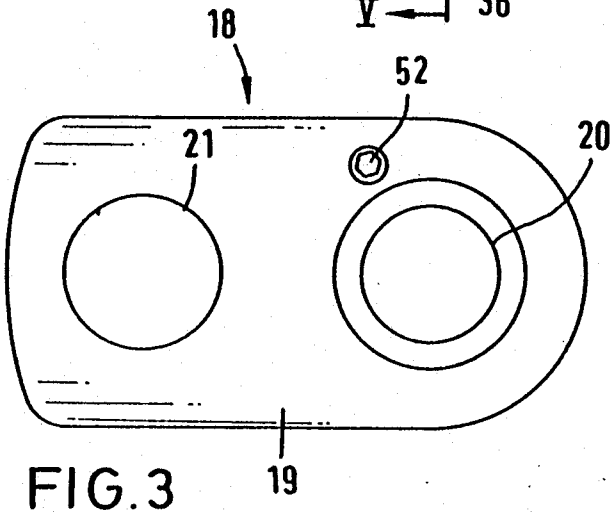
FIG. 3 is a front view of FIG. 2, seen in the direction of arrows III—III.

The shaft 29 extends inside a spacer tube 34 that keeps the ball bearings 27 and 28 at a mutual distance. The other end of the shaft 29 has the index disc 35 fastened thereto by means of a screw 56. The index disc has a number of equidistantly arranged arresting elements 36 in the form of holes. In the embodiment illustrated herein, ten arresting elements 36 are uniformly distributed over the circumference of the index disc 35 (FIG. 4). The arresting elements 36 may be engaged by blocking elements 37, 38 that are designed as blocking pins in this case Each of the two blocking elements 37 and 38 is operated by a double-acting air cylinder 39, 40. The air cylinders 39 and 40 are fastened at a front wall 41 that close the rear end of the housing 26 and defines the space of that housing accommodating the index disc 35. The front wall 41 is fastened to a flange of the housing 26 by screws 42.

Figure 5:
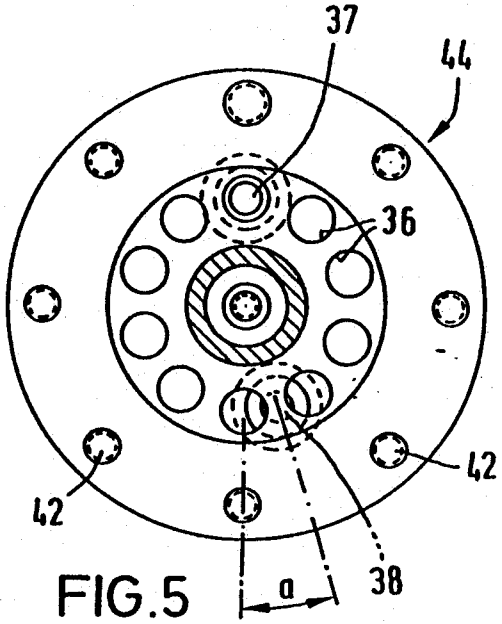
FIG. 5 is a schematic section along line V—V in FIG. 2.

Referring to FIG. 5, the blocking elements 37 and 38 are arranged such that they do not lie on a common diameter of the index disc 35. The blocking element 38 is offset by an angle a from the diameter on which the blocking element 37 is positioned. The angle a is half the circumferential angle *2a* of the distance between adjacent arresting elements 36 (FIG. 4). In the present embodiment that has ten arresting elements, the circumferential angle *2a* between two adjacent arresting elements is 36° so that all ten arresting elements add up to a complete revolution of 360°.

FIGS. 2 and 5 illustrate the state in which the blocking element 37 engages one of the arresting elements 36. In this state, the blocking element 38 is situated exactly in the middle between two arresting elements. The blocking element 38 has been withdrawn by its air cylinder. The blocking element 37 engaging one of the arresting elements prevents the index disc 35 from rotating. Since the draw pin 20 is fixedly connected with the index disc 35, rotation of the draw pin is blocked, too.

Together with the blocking elements 37, 38, the index disc forms a stepper switch device 44 that may switch the draw pin 20 further in angular steps a. If such an angular step a is to be performed, the air cylinder 40 is operated such that the blocking element 38 is advanced and abuts against the index disc 35. Thereafter, the air cylinder 39 is controlled such that its blocking element 37 is withdrawn, thereby releasing the index disc 35. Now, the index disc 35 may be pulled along by the draw pin 20 driven by the filaments until the blocking element 38 finds the next hole of the index disc and enters the same. Thus, the index disc is rotated at angular steps a of 18°, a complete rotation of 360° accordingly requiring twenty such angular steps.

The control of the air cylinders 39 and 40 may be effected at periodic intervals of several hours so that the draw pin is regularly rotated.

The longitudinal displacement of the draw pin 20 is effected by means of a spindle 50 that passes through a bore in the support block 19 and is secured against axial displacement by spring rings 51. An actuating head 52 is provided at one end of the spindle 50, e.g., a hexagonal member, with which to rotate the spindle.

The spindle 50 has a threaded portion 53 engaged with a inner thread of the front wall 41 of the housing 26. Upon rotation of the spindle 50, the housing 26 is displaced axially within the tube 25. FIG. 2 illustrates the end position in which the draw pin is extended farthest (to the right). A rotation of the spindle 50 will displace the housing 26 to the left relative to the support block 19, a part of the draw pin 20 being drawn into the tube 25. In this way, the areas of contact on which the filaments cause friction on the draw pin 20 may be changed axially on the draw pin.

Figure 6:
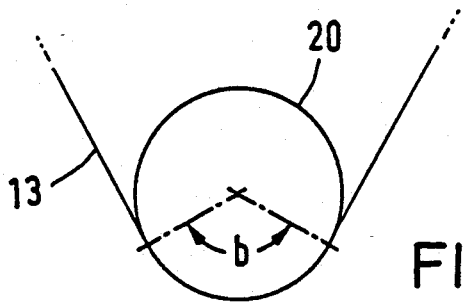
FIG. 6 is a schematic front view of the draw pin providing a better illustration of the wrap angle.

FIG. 6 schematically illustrates the wrap area b of 120° in which the filaments lie on the circumference of the draw pin 20. In the present embodiment the draw pin is switched further by an angular step of 18° in each switching operation. As a consequence, each circumferential area of the draw pin remains within the area of the wrap angle for seven angular steps a.

Figure 7:
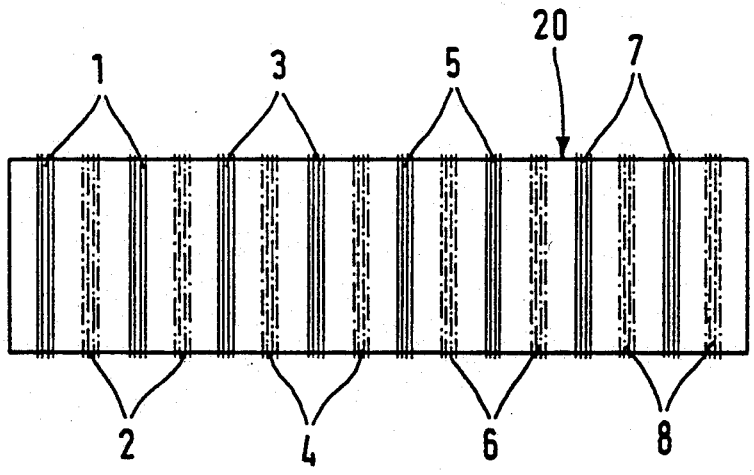
FIG. 7 is a side elevational view of the draw pin for a better illustration of the length portions employed in a plurality of successive steps.

FIG. 7 is a schematic illustration of the tracks of pairs of filament bundles relative to the draw pin 20. It is assumed that in a two-end operation the bundles in the positions indicated by 1 have passed along the draw pin first, i.e., that they have passed near one end of the draw pin. Upon completion of a step-wise performed 360° rotation of the draw pin, the draw pin is displaced axially so that positions 2 are used. In doing so, one takes advantage of the fact that the positions 1 show a mutual distance and that in between these positions there is an unused space. In the positions 2, one of the filament bundles runs between the previously used positions 1, whereas the other is offset outward. In each of the positions 1–8, the draw pin 20 is used until a 360° rotation has been completed stepwise.

Similarly, the device may be used for other numbers of filament bundles. The step-wise rotation of the draw pin may be controlled individually for each machine. It is also possible in a multi-position spinning machine to control all draw pins synchronously or sequentially so that the compressed air usage for the switching operations is concentrated at particular times.

I claim:

1. A drawing device for synthetic filaments comprising at least one draw pin having a circumference for sliding filaments frictionally against a portion thereof to form a wrap angle, said draw pin having a longitudinal axis and being rotatable about said longitudinal axis in order to change the portion of the pin circumference exposed to friction of the filaments a stepper switch device for stopping and releasing said pin after a predetermined time so that said draw pin rotates by a pulling affect of the filaments sliding over said draw pin for one angular step, said angular step being smaller than said warp angle.

2. The drawing device of claim 1, wherein said stepper switch device includes an index disc fixedly connected to said draw pin, said index disc having circumferentially distributed arresting elements; and blocking means capable of engaging said arresting elements but which when disengaged allows for rotation of said index disc in angular steps.

3. The drawing device of claim 2, wherein said blocking means comprises two blocking elements that are offset with respect to said index disc so that one blocking element is opposite one of said arresting elements, while a second blocking element is situated between two arresting elements,

4. A drawing device for synthetic filaments comprising at least one draw pin having a circumference for sliding filaments frictionally against a portion thereof to form a wrap angle, said draw pin having a longitudinal axis and being rotatable about said longitudinal axis in order to change the portion of the pin circumference exposed to friction of the filaments; a stepper switch device for stopping and releasing said pin after a predetermined time so that said pin can rotate for one angular step, said angular step being smaller than said wrap angle, said stepper switch device including an index disc fixedly connected to said draw pin, said index disc having circumferentially distributed arresting elements; and blocking means capable of engaging said arresting elements but which when disengaged allows for rotation of said index disc in angular steps, said blocking means comprising two blocking elements that are offset with respect to said index disc so that one blocking element is opposite one of said arresting elements while a second blocking element is situated between two arresting elements.

5. The drawing device of claim 4, wherein said blocking elements are driven by air cylinders that move said blocking elements to engage the arresting elements of said index disc and wherein said air cylinders may withdraw one blocking element from said index disc at a time.

6. The drawing device of claim 4, wherein said blocking elements are driven by elastic linear drives that move said blocking elements to engage the arresting elements of said index disc and wherein said linear drives may withdraw one blocking element from said index disc at a time.

7. The drawing device of any of claims 4, 5 and 6, wherein said stepper switch device is axially movable together with said draw pin and including an actuating device for axially displacing said draw pin and said stepper switch device.

* * * * *